United States Patent [19]

Davis et al.

[11] Patent Number: 4,623,179

[45] Date of Patent: Nov. 18, 1986

[54] DOOR LATCH FOR APPLIANCE

[75] Inventors: G. Jerry Davis; John C. Mellinger, both of Newton, Iowa

[73] Assignee: The Maytag Company, Newton, Iowa

[21] Appl. No.: 838,412

[22] Filed: Mar. 10, 1986

Related U.S. Application Data

[63] Continuation of Ser. No. 565,638, Dec. 27, 1983, abandoned.

[51] Int. Cl.[4] ..... E05C 3/06; E05C 5/04

[52] U.S. Cl. ..... 292/201; 68/12 R; 292/64; 292/DIG. 69

[58] Field of Search ..... 292/144, 201, 57–66, 292/68, 69, DIG. 69; 68/12 R, 23 R

[56] References Cited

U.S. PATENT DOCUMENTS

| | | | |
|---|---|---|---|
| 1,423,773 | 7/1972 | Mathews | 292/66 X |
| 2,910,317 | 10/1959 | Conlee | 292/64 |
| 3,272,935 | 9/1966 | Beller et al. | 200/61.7 |
| 3,627,960 | 12/1971 | Grabek | 200/61.64 |
| 3,638,457 | 2/1972 | Filipak | 68/12 R |
| 3,642,313 | 2/1972 | Anderson | 292/DIG. 69 X |
| 3,763,670 | 10/1973 | Harrold | 68/12 R |
| 3,859,979 | 1/1975 | Gilliom | 292/DIG. 69 X |
| 3,865,097 | 2/1975 | Robinson | 292/DIG. 69 X |
| 4,074,545 | 2/1978 | Case | 292/DIG. 69 X |
| 4,082,078 | 4/1978 | Thuleen et al. | 292/DIG. 69 X |
| 4,342,476 | 8/1982 | Brown et al. | 292/DIG. 69 X |

FOREIGN PATENT DOCUMENTS

| | | | |
|---|---|---|---|
| 2041438 | 6/1980 | United Kingdom | 292/DIG. 69 |

*Primary Examiner*—Robert L. Wolfe
*Assistant Examiner*—Russell W. Illich
*Attorney, Agent, or Firm*—Richard L. Ward

[57] ABSTRACT

A door latch is provided for the access door of an appliance. The door latch apparatus includes bracketry for mounting at least one switch and actuating levers. The movable access door includes a catch which is engageable with one of the actuating levers as the access door is closed for sensing if the access door is in a lockable posture. Another actuating lever is pivotally operated by a solenoid actuator under control of a microcontroller-based controller to position one end of the lever into locking engagement with the access door catch and to actuate a switch for providing a signal to the controller that the access door is closed and locked.

7 Claims, 8 Drawing Figures

DOOR LATCH FOR APPLIANCE

This is a continuation of application Ser. No. 565,638 filed Dec. 27, 1983, now abandoned.

BACKGROUND OF THE INVENTION

This invention relates generally to the field of household appliances and more particularly to providing latching mechanism for locking the door of an appliance in a closed position during a cycle of operations to prevent operator access to moving parts.

Various appliances which have previously included door latching devices have generally provided a variety of solenoid actuated devices wherein the door is latched during specific portions of a cycle of operations. These appliances generally have included a door with a catch or other member which is engageable with a switch to condition the circuitry of the appliance for operation.

Conlee, U.S. Pat. No. 2,910,317, discloses a solenoid which is actuated to pull a tongue associated with a bolt into engagement with a slot in the latch element of the cover to positively lock the cover in place. The cover is locked only during high speed spin.

Beller et al, U.S. Pat. No. 3,272,935, is another example of a lid latch which is actuated only during the spin portion of a cycle of operations. The latch member will pivot a switch actuating lever to close the switch when the lid is closed. The electromagnet is not actuated for pivoting the latch lever into engagement with the latch until the spin cycle has begun. If the switch is not closed, the machine will not spin.

Grabek, U.S. Pat. No. 3,627,960, shows a keeper which extends downwardly through an aperture in a flange to close a switch as the lid is closed. This action conditions the appliance circuitry so that the solenoid can be actuated during the cycle to engage the locking leg of the latch with the keeper.

Filipak, U.S. Pat. No. 3,638,457, includes a solenoid actuated lid latch which prevents opening of the lid during spin. Also, the spin cycle cannot be initiated if the lid is open. A catch on the lid closes a lid switch.

Harrold, U.S. Pat. No. 3,763,670, teaches an automatic clothes washing machine where closing the access lid allows a keeper to strike an anvil which moves downwardly to rotate a latch which moves a slide to actuate a first switch. Actuating the first switch energizes a solenoid, if an associated timer switch is closed, to move a locking arm into engagement with the slide to lock the access lid and close a second switch. The first and second switches as well as the solenoid are in the spin circuit of the drive motor and combine to assure that the washing machine cannot be operated in the spin portion of the cycle unless the access lid is closed. The second switch and solenoid, are operable only during the spin portion of the cycle.

There have thus been shown a number of solenoid actuated door latches for appliances which are energized only during specific portions of the cycle. These latch mechanisms generally include apparatus for actuating a line or door switch which will condition the appliance circuitry for operation. The present application provides a latching mechanism controlled by a microcontroller and including means for sensing that the access door is in a closed and lockable posture. Upon locking the access door, switch means provides a signal to the microcontroller that the access door is closed and locked.

SUMMARY OF THE INVENTION

It is therefore an object of the instant invention to provide an improved appliance door latch apparatus.

It is a further object of the instant invention to provide an appliance door latch apparatus which may be energized during an entire cycle of operations and which is operable for sensing the posture of the appliance door and for communicating that posture to the microcontroller.

Briefly, the instant invention achieves these objects in a latching apparatus for the access door of an appliance. An electrical power source provides electrical power between a pair of electrical conductors to power the appliance. A programmable controller controls operation of the appliance and the latching apparatus. A catch is mounted on a movable access door. Bracketry is provided for mounting the latching apparatus on the appliance generally adjacent the catch with the access door in the access-closed position. Locking mechanism includes a lever member and is engageable with the catch with the access door in a closed and lockable posture. Electrically energizable actuating mechanism is operatively attached to the lever member for movement thereof between a first mode and a catch-locking second mode. A switch is actuated by the lever member upon movement of the locking mechanism to the catch-locking mode, the locking mechansim being operable for engagement with the catch in the first mode to sense the proper positioning of the access door in a closed and lockable posture. The locking mechanism is further operable to the catch-locking second mode to prevent movement of the access door from the closed posture, the lever member being substantially concurrently operable for actuating the switch to provide a signal to the programmable controller that the access door is closed and locked.

Operation of the door latching apparatus and further objects and advantages thereof will become evident as the description proceeds and from an examination of the accompanying three sheets of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
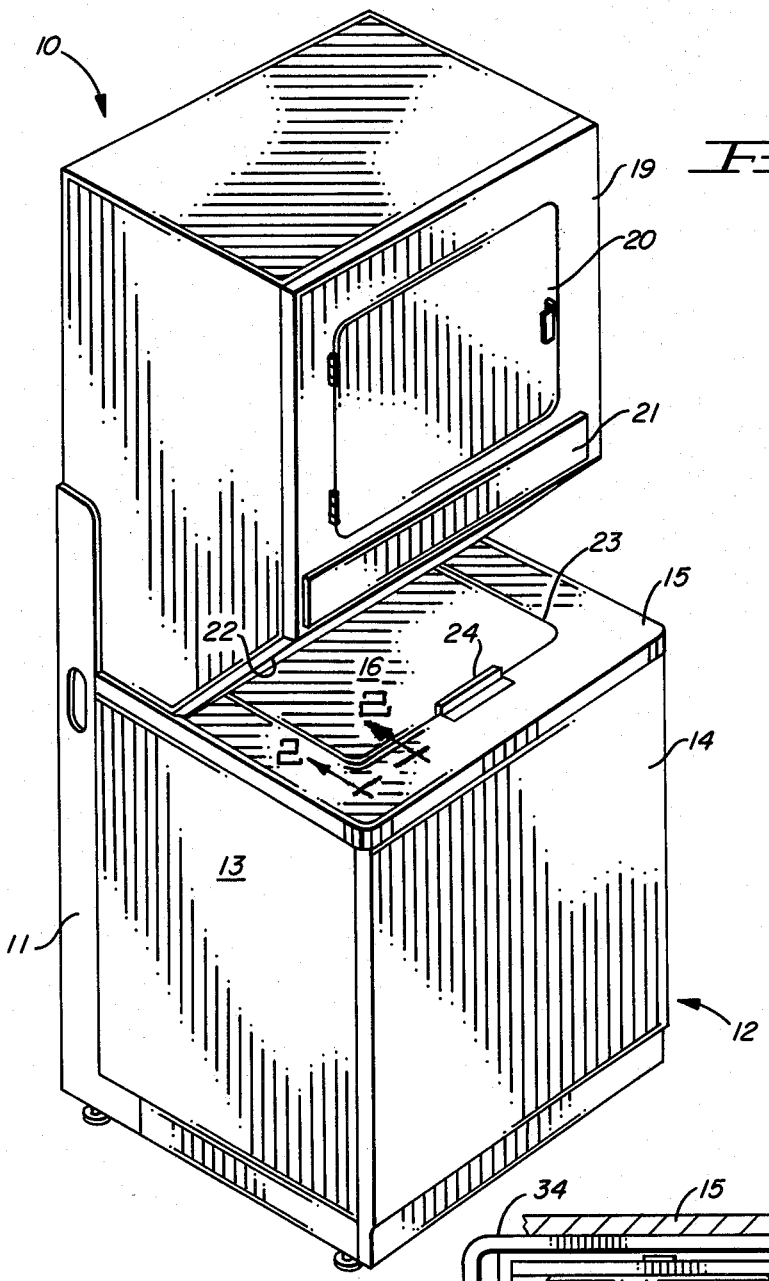
FIG. 1 is an isometric view of a washer/dryer appliance pair mounted in a stack arrangement.

Referring now to the drawings and in particular to FIG. 1, there is shown a pair of laundry appliances with a fabric dryer 10 mounted on an appliance support stand 11 above an automatic washing machine 12.

Briefly, in this embodiment of the invention, the automatic washing machine 12 is housed within a generally rectangular cabinet having a three-sided enclosure member forming the sides 13 and rear (not shown) of the cabinet. A vertically oriented front panel 14 completes the peripheral cabinet of the washing machine 12. The cabinet of the washing machine 12 also includes a substantially horizontally disposed top cover 15 having a slidable access door 16 for providing access to the interior of the washing machine 12.

The fabric dryer 10 is mounted in a cantilevered fashion on the support stand 11 directly above the washing machine 12 and has a generally rectangular enclosure which is substantially shorter in front-to-back depth than that of the washing machine 12. The vertically oriented dryer front panel 19 includes an access door 20 for loading and unloading fabrics to be dried. Controls, such as control panel 21, may be positioned on the dryer 10 and/or washer 12 through which the washer 12 and dryer 10 are controlled. As further shown in FIG. 1, the lower front panel portion 22 of the dryer 10 tapers rearwardly from a point adjacent the bottom edge of the control panel 21. The lower edge of the dryer lower front panel portion 22 is adjacent to but spaced slightly above the top cover 15 of the washing machine 12. The dryer heater and drive assembly (not shown) are located within the lower part of the dryer 10 behind the sloping lower front panel portion 22.

As previously discussed, the horizontally disposed top cover 15 completes the enclosure of the washing machine 12 and is generally rectangular in shape. The top cover 15 includes a generally centrally located rectangular depression 23 for receiving the front-to-rear movable sliding access door 16. With the access door 16 placed in the rectangular depression 23, the access door 16 is manually slidable by the handle 24 from a forward or closed position to a rearward or open position for providing access to the interior of the washing machine 12.

Figure 2:
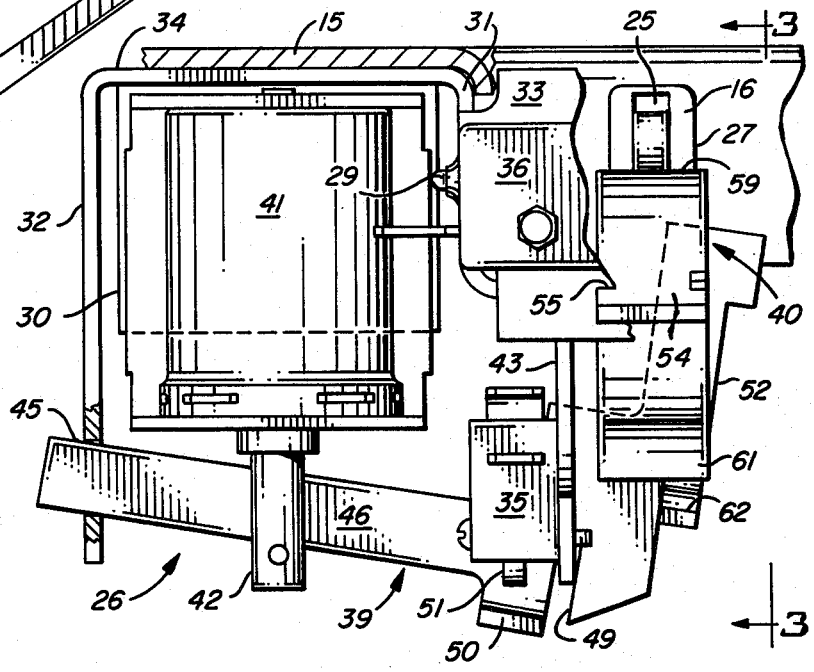
FIG. 2 is a fragmentary section view showing the access door latching apparatus for the washer taken generally along lines 2—2 of FIG. 1.
Figure 3:
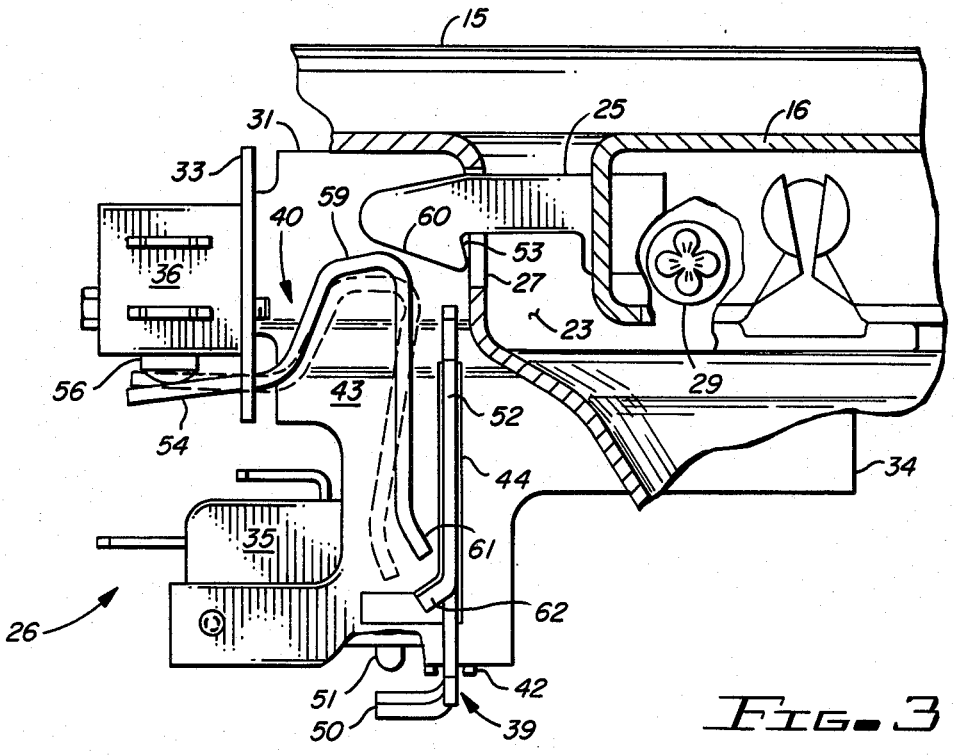
FIG. 3 is a fragmentary section view of the access door latching apparatus generally along lines 3—3 of FIG. 2.

As best shown in FIGS. 2 and 3, the left front corner of the access door 16, when viewed from the front of the washing machine 12, includes a catch hook 25 which extends forwardly through the opening 27 in the forward wall of the rectangular depression 23. As further shown in FIGS. 2 and 3, a latching mechanism 26 is secured to the side wall of the rectangular depression 23 below the top surface of the top cover 15 by a single threaded fastener 29 which extends through the side wall of the depression 23 and into a flange 31 of the latching mechanism mounting bracket 34. The mounting bracket 34 is located in direct contact with the underside of the top cover 15 for preventing movement of the latching mechanism 26 about the fastener 29.

Referring again to FIGS. 2 and 3, the access door latching mechanism 26 is comprised of an assembly of switches 35 and 36, levers 39 and 40 and a solenoid 41 mounted in a cooperative arrangement on the four generally vertically oriented flanges 30–33 of the mounting bracket 34. FIG. 2 shows the solenoid 41 attached to the flange 30 with the clevis or bifurcated end 42 of the solenoid armature extending downwardly. As further shown in FIG. 2, the generally vertical walls or flanges 31 and 32 are located on each side of the solenoid mounting flange 30. The right-hand or vertical flange 31 is utilized for mounting the latching mechanism 26 to the top cover 15 through the fastener 29 which taps into the flange 31 and, as shown in FIG. 2, includes an extension portion 43 which is offset downwardly and to the right. The offset extension portion 43 of the right-hand flange 31 is utilized for mounting a lock switch 35 which will be further discussed herein. The flange 33 of the mounting bracket 34 is substantially an extension of flange 31 and is formed to be generally perpendicular to the flange 31 for mounting an access door switch 36.

As further shown in FIGS. 2 and 3, the flanges 31 and 32 contain vertically oriented slots 44 and 45 generally aligned in a common vertical plane when viewed in FIG. 3. As best shown in FIG. 3, the slot 44 in the flange 31 is vertically elongated to allow pivotal movement of a generally L-shaped access door latch lever 39. As FIG. 2 indicates, a first leg 46 of the L-shaped access door latch lever 39 extends through the vertically elongated slot 44 in the offset extension portion 43 of the vertical flange 31 of the mounting bracket 34, through the clevis 42 of the solenoid armature and through the slot 45 in the vertical flange 32 of the mounting bracket 34. The first leg 46 of the L-shaped access door latch lever 39 includes a downwardly opening notch 49 which is engageable with the offset extension portion 43 of the flange 31 or the mounting bracket 34 for maintaining the access door latch lever 39 in the posture of FIG. 2. The first leg 46 of the access door latch lever 39 further includes a tab 50 which is operably engageable with the actuator button 51 of the lock switch 35 when the solenoid 41 is actuated for pivoting the L-shaped access door latch lever 39 about the slot 45 in the flange 32. The second leg 52 of the L-shaped access door latch lever 39 extends upwardly at substantially a right angle to the first leg 46 and the upper extremity thereof will be moved into locking engagement with the edge 53 of the catch hook 25 when the access door 16 is closed and the solenoid 41 is actuated for pivoting the L-shaped access door latch lever 39 in a counter-clockwise direction about slot 45.

As best shown in FIG. 3, the vertical flange 33 of the mounting bracket 34 mounts the previously mentioned access door switch 36. An access door switch lever 40 is pivotally mounted on the flange 33 with one end portion 54 extending to the left through the pivot slot 55 for engaging with the actuator button 56 of the access door switch 36. The access door switch lever 40 further includes a radiused center portion 59 which extends upwardly and to the right of the pivot slot 55 and is generally aligned with a tapered cam segment 60 of the access door catch hook 25. The access door switch lever 40 further extends downwardly from the radiused center portion 59 and terminates in a stop portion 61 which extends angularly to the right and is engageable with an abutment 62 formed in the second leg 52 of the L-shaped access door latch lever 39 to block actuation of the lock switch 35 should the solenoid 41 be actuated when the access door 16 is in an open posture.

The preferred embodiment of the door latch mechanism described herein is also described but not claimed in a copending application Ser. No. 565,734 which issued as U.S. Pat. No. 4,510,777 on April 16, 1985 and entitled "Control System for an Access Door". This patent issued to David I. Ellingson and James D. Wilson and is assigned to the assignee of the instant invention.

Figure 4:
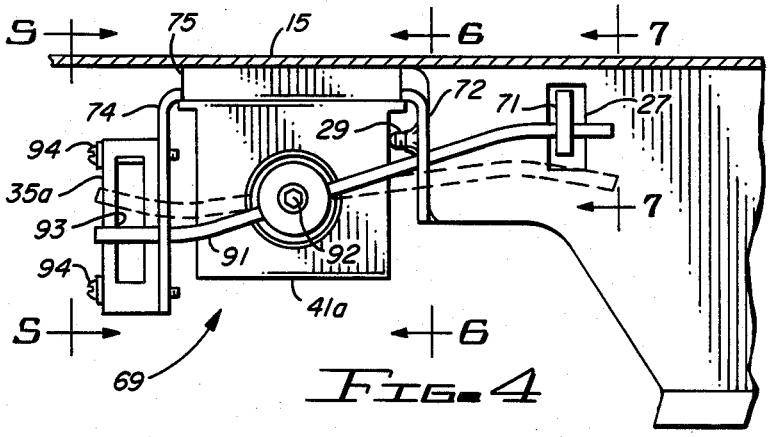
FIG. 4 is a fragmentary section view showing an alternate embodiment of the access door latching apparatus and taken generally along the same lines as FIG. 2 of the preferred embodiment.
Figure 5:
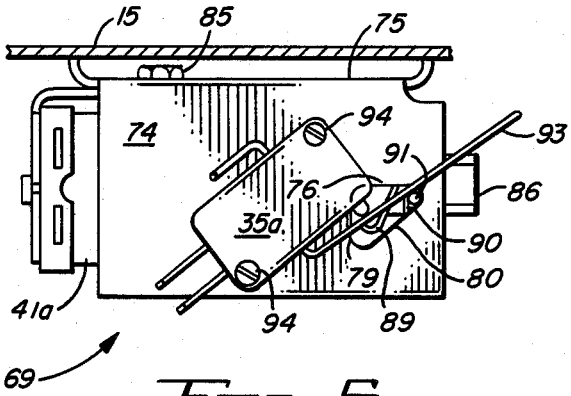
FIG. 5 is a view taken generally along lines 5—5 of FIG. 4 showing a side view of the alternate embodiment of the door latching apparatus.
Figure 6:
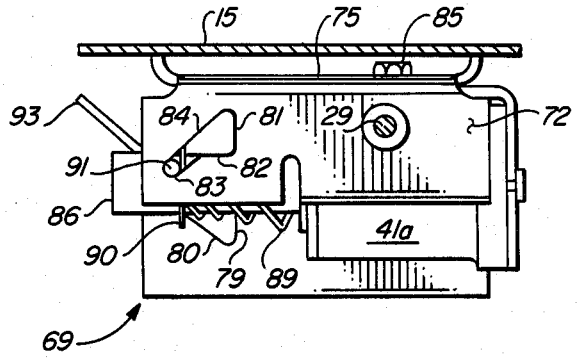
FIG. 6 is a section view taken generally along lines 6—6 of FIG. 4 and showing the opposite side of the alternate embodiment of the door latching apparatus.
Figure 7:
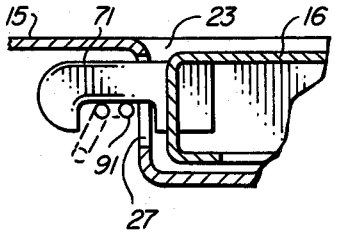
FIG. 7 is a fragmentary section view taken generally along lines 7—7 of FIG. 4 and showing the arrangement of the catch and latch components of the alternate embodiment when the access door is closed.

Turning now to FIGS. 4–7, there is shown an alternate embodiment of a solenoid operated latching arrangement 69 which may be energized for locking the access door 16 in the closed posture during a cycle of operations. As best shown in FIGS. 4 and 7, the left front corner of the access door 16 includes a hook-shaped catch 71 which extends through the opening 27 in the forward wall of the rectangular depression 23 when the access door 16 is in the closed position. As in the preferred embodiment of FIGS. 2 and 3, a threaded fastener 29 extends through the side wall of the rectangular depression 23 and into a flange 72 for attaching the latching arrangement 69 under the top cover adjacent the left front corner of the rectangular depression 23.

As further shown in FIG. 4, the latching arrangement 69 includes a pair of spaced-apart downwardly extending flanges 72 and 74 joined by a substantially horizontal central wall portion 75. The left flange 74, as best shown in FIG. 5, includes a triangular cut-out or cam arrangement having a horizontal top segment 76, a downwardly extending left side segment 79 and an upwardly sloping lower segment 80. The right flange 72, as best shown in FIG. 6, includes a cut-out or cam arrangement which has a vertical right segment 81, a horizontal segment 82 extending to the left from the bottom of the vertical segment 81, and a slotted segment 83 which slopes downwardly and to the left from the left extremity of the horizontal segment 82. The upper surface 84 of the slotted segment 83 extends toward and joins the top of the vertical right segment 81.

It is noted that similar numerals are utilized for the basic circuitry components of both embodiments of the instant invention. The alternate embodiment components are further identified with a subscript "a". A solenoid 41*a* is mounted to the central wall portion 75 in an underslung arrangement as indicated in FIGS. 4–6. The solenoid 41*a* is attached to the bracketry by mechanical fasteners 85. The armature 86 of the solenoid 41*a* is biased in an outward direction by a coil spring 89 which is axially retained on the armature 86 by a washer 90. As best shown in FIG. 4, a formed wire latch 91 extends transversely through the armature 86 and captures the retaining washer 90 and spring 89. As further shown in FIG. 4, the latch 91 extends through the cut-outs or cam arrangements in the flanges 72 and 74 of the bracketry 73 and is positively secured to the armature 86 by a set screw 92 which is tapped into the end of the armature 86.

FIGS. 4 and 5 show a lock switch 35*a* attached to the left flange 74 of the bracketry 73. The lock switch 35*a* includes an operating lever 93 and is secured to the flange 74 by a pair of threaded fasteners 94 in such a manner that the operating lever 93 extends generally parallel to and slightly above the sloping lower segment 80 of the triangular cut-out or cam as best shown in FIG. 5.

The latching arrangement 69 of FIGS. 4–7 will operate in the following manner if the access door 16 is in the closed position: As the solenoid 41*a* is energized and the armature 86 is retracted, the latch 91 and armature 86 will be pivoted to follow the sloping lower segment 80 of the triangular cut-out or cam in the left flange 74 and the upper surface 84 of the slotted segment in the cut-out or cam of the right flange 72. When the right end of the latch 91 contacts the bottom of the catch 71, as best shown in FIG. 7, the latch 91 will stop pivoting and will be drawn toward the access door 16 along a generally horizontal path corresponding substantially to the horizontal segment 82 of the cut-out or cam in the right flange 72. This horizontal movement will effect corresponding horizontal movement of the left end of the latch 91 toward the operating lever 93 of the lock switch 35*a* to close the electrical contacts of the lock switch 35*a*.

If, for some reason, the access door 16 has not been closed, energization of the solenoid 41*a* will cause the left and right ends of the latch 91 to follow the sloped segments 80 and 84 of the cut-outs or cams throughout the stroke of the armature 86. When this happens, the left end of the latch 91 will move in a path generally parallel to the operating lever 93 but will not actuate the lock switch 35*a*. Thus, when the microcontroller 95 checks the condition of the lock switch 35*a*, it will detect that the contacts are open which is an indication that the access door 16 is open and unlatched.

Figure 8:
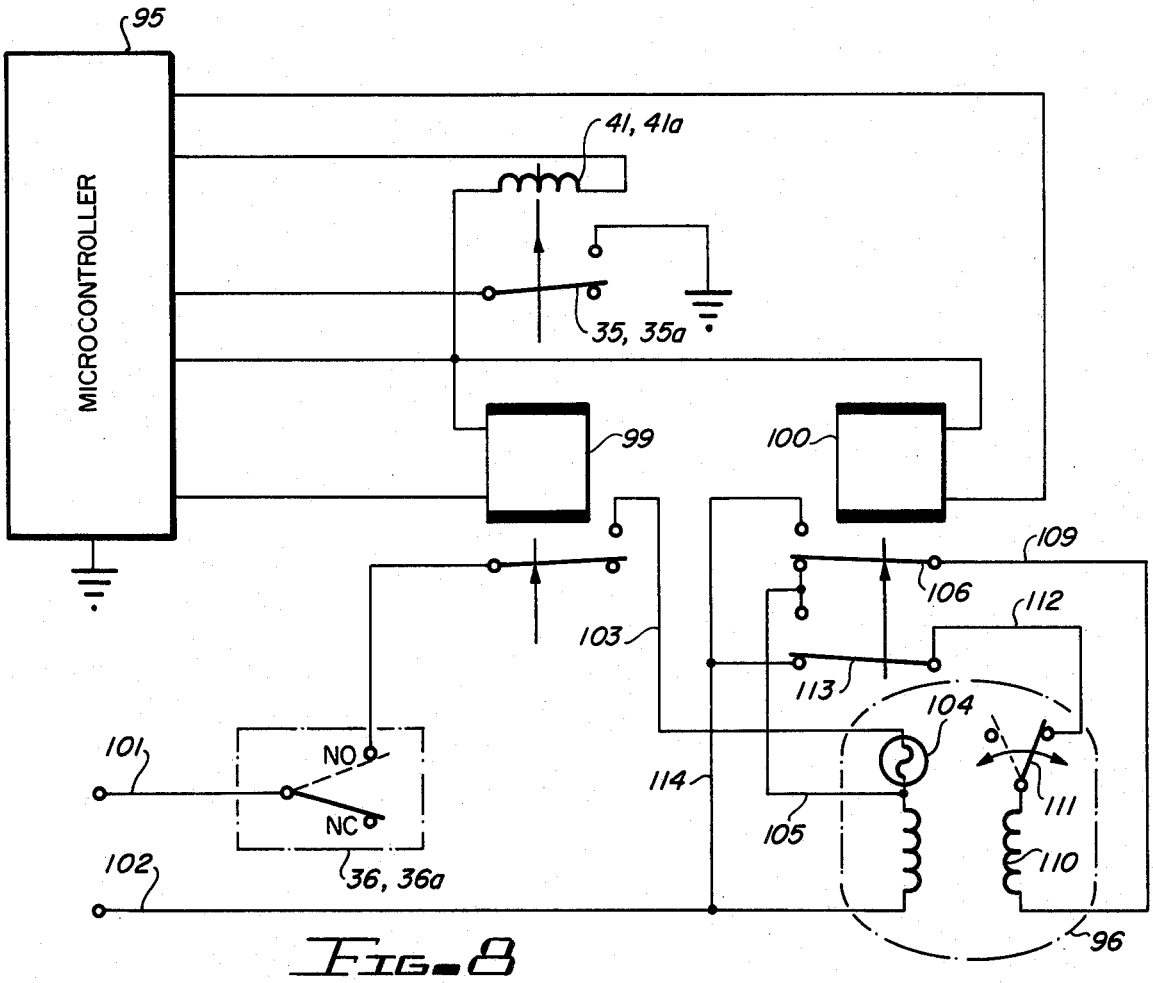
FIG. 8 is an electrical schematic of the operational circuitry for the access door latching apparatus.

Referring now to FIG. 8, there is shown a partial electrical schematic circuit for the washing machine 12 of the preferred embodiment of the instant invention including the microcontroller 95 generally designated by a rectangle which includes the microprocessor, latch, power supply and associated interfacing circuitry. The schematic circuit further includes lock and access door switches designated 35, 35*a* and 36 respectively to cover both embodiments of the invention and the microcontroller operated solenoid designated 41 and 41*a* utilized in the latching mechanism. The circuit of FIG. 8 further includes a drive motor 96, a run relay 99, and a spin or directional relay 100 for the washing machine 12. In the washer/dryer combination shown in FIG. 1, the washer and dryer drive motors are separately connected to 120 VAC through individual power cords. The low voltage power supply for the microcontroller 95 is taken from the dryer side of the circuit and a low voltage interconnection, 24 VDC in this embodiment, is made between the microcontroller 95 and the low voltage relays 99 and 100 and solenoid 41, 41*a*.

In the circuit of FIG. 8, 120 VAC electrical power is supplied to the washing machine 12 between conductors 101 and 102. The general operation of the control circuitry as related to the preferred embodiment of the invention can best be described in conjunction with the mechanical actuation of the latching mechanism 26 of FIGS. 2 and 3 by closing the access door 16 and by energization of the solenoid 41 which is controlled by the microcontroller 95.

In the preferred embodiment of the invention, the washing machine 12 and the microcontroller 95 are initially powered by pressing a cycle selection pad associated with the control panel 21 mounted on the fabric dryer 10 and as generally shown in outline form in FIG. 1. Prior to pressing a cycle selection pad, the access door 16 is closed by manually sliding it forward in the rectangular depression 23 of the top cover 15 to pass the latch hook 25 through the opening 27 in the forward wall of the rectangular depression 23 and for physically engaging the tapered cam segment 60 of the catch hook 25 with the radiused center portion 59 of the access door switch lever 40. Closing the access door 16 in this manner will cause the tapered cam segment 60 of the catch hook 25 to pivot the access door switch lever 40 clockwise in the slot 55 to the dashed line posture of FIG. 3 and move the access door switch 36 from the normally closed to the normally open contact as shown in dashed line posture in FIG. 8 for sensing that the access door 16 is in a closed and lockable posture.

As a cycle of operations is initiated by the microcontroller 95, the lock switch 35 is first checked by the microcontroller 95 to ensure that the switch contacts are open as they should be prior to actuating solenoid 41 to close the contacts of lock switch 35. This preprogrammed check is made to verify that the contacts of the lock switch 35 are not welded shut or otherwise defeated. After the contacts of the lock switch 35 have been checked and verified open, the solenoid 41 is energized by the microcontroller 95 to pivot the L-shaped access door latch lever 39 in a counter-clockwise direction about the slot 45 in the flange 32 of the mounting bracket 34 for moving the tab 50 into operating engagement with the actuator button 51 of the lock switch 35. The upper extremity of the second leg 52 of the L-shaped access door latch lever 39 will be concurrently moved into locking engagement with the edge 53 of the catch hook 25. The contacts of the lock switch 35 are now closed and a circuit path is completed from the microcontroller 95 through the lock switch 35 to ground. This circuit path to ground provides a signal to the microcontroller 95 that the access door 16 has been closed and locked.

If the access door 16 is not in the closed posture, the access door switch lever 40 will remain in the full line posture of FIG. 3. With the switch lever 40 in the full line posture when the solenoid 41 is actuated, the angularly extending stop portion 61 of the access door switch lever 40 will engage the abutment 62 on the second leg 52 of the L-shaped access door latch lever 39 to block pivotal movement of the door latch lever 39. This action will prevent actuation or closing of the lock switch 35 and, as the preprogrammed microcontroller 95 continues to monitor the condition of the lock switch 35, it will be determined that the access door 16 is not in a lockable position and the selected cycle will not be initiated.

When the condition of the lock switch 35 has been checked by the microcontroller 95 to ensure that the access door 16 is closed and locked, the microcontroller 95 will initiate the energization of the run and/or spin relays 99 and/or 100 depending on the cycle selected. If, for example, a cycle requiring agitation is selected, the microcontroller 95 will first energize a tub fill circuit (not shown) which will fill the tub of the washing machine 12 to the proper level for washing a particular load of fabrics. Once the fill operation has been completed, the run relay 99 will be energized to complete a circuit from conductor 101, through the access door switch 36 which has been moved to the dashed line normally open posture by the access door switch lever 40, through the now closed contacts of the run relay 99, through conductor 103, thermoprotector 104, conductor 105, first spin relay contact 106, conductor 109, start winding 110, centrifugal switch 111, conductor 112, second spin relay contact 113, and conductor 114 to conductor 102. Once the drive motor 96 reaches run speed, the centrifugal switch 111 will open and the start winding 110 will drop out of the circuit.

If a cycle selection calls for spin or rotation of the drive motor 96 in the reverse direction, the microcontroller 95 will first energize the spin relay 100 to move the first and second switch contacts 106 and 113 in the direction of the arrow to a second posture. The run relay 99 will then be energized to complete the run circuit for the drive motor 96 but in an opposite direction of rotation from agitate since the start winding 110 will be energized in the reverse direction.

Although the mechanism shown and described is physically different from that of FIGS. 2 and 3, the alternate embodiment of the instant invention functions in a similar manner to lock the access door 16 and the control circuitry of FIG. 8 is also pertinent to this embodiment. In the alternate embodiment of the invention an access door switch **36*a* corresponding to switch 36 of the preferred embodiment is actuated by the side of the access door 16 as it is opened and closed. As in the preferred embodiment, when a cycle of operations is initiated by the microcontroller 95, the lock switch 35*a* is first checked by the microcontroller 95 to ensure that the switch contacts are open. After the contacts of the lock switch 35*a* have been checked and verified open, the solenoid 41*a* is energized by the microcontroller 95 to move the latch 91 into engagement with the catch 71 and to close the contacts of the lock switch 35*a***.

The latch and catch arrangements described herein have been directed to the sliding access door 16 of the washing machine 12 of a washer/dryer stack pair. It can, however, be readily seen that the latch and catch arrangements could also be applied to the pivoted access door 20 of the dryer 10 if there were any reason for requiring that the dryer access door 20 be locked during the drying cycle. The latch and catch arrangement is thus applicable to either a sliding or pivoted access door for any appliance.

It can thus be seen that the instant invention provides an improved appliance door latching system which is mechanically actuated when the appliance access door is manually closed through an actuating lever to operate an access door switch. The microcontroller is programmed to ensure the posture and lockability of the access door by sensing the presence of the catch through a lock switch. The microcontroller will energize a solenoid to position a door latching lever in locking engagement with the access door catch when it has determined that the access door is in a closed and lockable posture. The microcontroller receives a signal from the lock switch contacts throughout a cycle of operations for determining the posture of the appliance access door on a continuing basis. The door latching system provided herein prevents operation of the appliance in the event that the access door is not closed and locked.

In the drawings and specification there is set forth a preferred embodiment of the invention and although specific terms are employed these are used in a generic and descriptive sense only and not for purposes of limitation. Changes in the form and the proportion of parts as well as the substitution of equivalents are contemplated as circumstances may suggest or render expedient without departing from the spirit or scope of the invention as further defined in the following claims.

We claim:

1. An appliance including an access door and latching apparatus therefor, the combination comprising: operating means disposed within said appliance, said access door controlling access to said operating means and movable between an access-open and an access-closed position; an electrical power source for providing electrical power between a pair of electrical conductors to power said appliance; microcontroller-based program means for controlling operation of said appliance and said latching apparatus; a catch mounted on said movable access door; means for mounting said latching appatatus on said appliance generally adjacent said catch when said movable access door is in the access-closed position; locking means including a lever member and engageable with said catch when said access door is in a closed and lockable posture; electrically energizable actuating means operatively attached to said lever member for movement thereof between a catch-unlocked first mode and a catch-locking second mode; switch means actuated by said lever member upon movement of said lever member to said catch-locking second mode, said locking means being operable for engagement with said catch to sense the proper positioning of said access door and operable for preventing energization of said actuating mcans when said access door is not in a closed and lockable posture and for preventing movement of the access door when said access door is properly located in said access-closed position, said lever member while moving into engagement with said catch being substantially concurrently operable for actuating said switch means from a door-unlocked first posture to a door-locked second posture to provide a signal to said microcontroller-based program means indicating that said access door is closed and locked, and monitoring means included in said microcontroller-based program means for sensing the posture of said switch means and the mode of said actuating means, said microcontroller-based program means including means for preventing operation of said appliance upon sensing said switch means in said door-locked second posture while sensing said actuating means in said catch-unlocked first mode whereby energization of said actuating means is allowed only if said access door is closed and lockable and operation of said appliance is allowed only if said access door is closed and locked.

2. An appliance including an access door and latching apparatus therefor as defined in claim 1 wherein said locking means includes a second lever member engageable by said catch with said access door in said closed and lockable posture for actuating a line switch electrically associated with said power source.

3. An appliance including an access door and latching apparatus therefor as defined in claim 2 wherein said second lever member releases said first lever member for movement concurrently with operation of said line switch.

4. An appliance including an access door and latching apparatus therefor as defined in claim 1 wherein said actuating means includes a solenoid having an armature portion operatively attached to said lever member and energizable under control of said program means from said first mode to said catch-locking second mode if said access door is sensed to be in a closed and lockable posture.

5. An appliance including an access door and latching apparatus therefor, the combination comprising: operating means disposed within said appliance, said access door controlling access to said operating means and movable between an access-open and an access-closed position; an electrical power source for providing electrical power between a pair of electrical conductors to power said appliance; microcontroller-based program means for controlling operation of said appliance and said latching apparatus through a cycle of operations; a catch mounted on said movable access door; bracket means mounted on said appliance generally adjacent said catch with said movable access door in the access-closed position; a line switch actuatable upon movement of said access door to said access-closed position for connecting said power source across said pair of electrical conductors to condition said appliance for operation when said access door is in the access-closed position; a switch actuating lever movable responsive to contact by said catch for actuating said line switch, actuation of said line switch being representative of a closed and lockable posture of said access door; a door latch lever supported on said bracket means and having a first end and a second end and being pivotable so that said second end is engageable with said catch for locking said access door in the access-closed position if said access door is in said closed and lockable posture, said door latch lever including means engageable with said switch actuating lever to prevent movement of said door latch lever if said access door is not in said closed and lockable posture; a solenoid in circuit with said microcontroller-based program means for actuation during said cycle of operations and including an armature operatively attached to said door latch lever, said solenoid being energizable under control of said microcontroller-based program means for pivoting said door latch lever from a catch-unlocked first mode to effect engagement of said second end with said catch in a catch-locked second mode if said access door is in a closed and lockable posture; a lock switch in circuit association with said microcontroller-based program means and actuated from a door-unlocked first posture to a door-locked second posture by said door latch; and monitoring means included in said microcontroller-based program means for sensing the posture of said lock switch and the mode of said solenoid, said microcontroller-based program means including means for preventing operation of said appliance upon sensing said lock switch in said door-locked second posture while sensing said solenoid in said door-unlocked first mode whereby energization of said solenoid is allowed only if said access door is closed and lockable and operation of said appliance is allowed only if said access door is closed and locked.

6. An appliance including an access door and latching apparatus therefor, the combination comprising: operating means disposed within said appliance, said access door controlling access to said operating means and movable between an access-open and an access-closed position; an electrical power source for providing electrical power between a pair of electrical conductors to power said appliance microcontroller-based program means for controlling operation of said appliance and said latching apparatus; a catch mounted on said movable access door; means for mounting said latching apparatus generally adjacent said catch with said movable access door in the access-closed position and including at least a pair of vertically oriented, spaced-apart flanges; cam means defined by a cut-out in each of said spaced-apart flanges; latch means including first and second end portions extending through said cut-outs for engagement with said cam means, said first end of said latch means being engageable with said catch when said access door is in a closed posture to sense the presence of said catch for determining that said access door is in a closed and lockable posture; a switch actuated by said second end portion of said latch means to provide a signal to said program means that said access door is closed and locked; and actuating means including a solenoid mounted between said spaced-apart flanges and including an armature portion operatively attached to said latch means, said solenoid being energizable under control of said program means for effecting the locking of said access door and actuating said switch by moving said latch means with respect to said cam means, said cam means having sloped surfaces for guiding the end portions of said latch means including initial pivotal movement thereof and, if said access door is in a lockable posture, secondary linear movement for locking said access door and actuating said switch.

7. An appliance including an access door and latching apparatus therefor as defined in claim 6 wherein said cam means includes means for guiding said latch means in a path to prevent actuation of said switch means when said access door is in an unlockable posture.

* * * * *

UNITED STATES PATENT AND TRADEMARK OFFICE

CERTIFICATE OF CORRECTION

PATENT NO. : 4,623,179

DATED : November 18, 1986

INVENTOR(S) : G. Jerry Davis et al.

It is certified that error appears in the above-identified patent and that said Letters Patent is hereby corrected as shown below:

Column 2, line 28, "mechansim" should read -- mechansim --.

Column 4, line 31, "or" should read -- of --.

Column 10, line 29, after "latch" insert -- lever --.

Column 10, line 48, after "appliance" insert -- ; --.

Signed and Sealed this

Fourteenth Day of April, 1987

*Attest:*

*Attesting Officer*

DONALD J. QUIGG

*Commissioner of Patents and Trademarks*